US011342090B2

(12) United States Patent
Walker

(10) Patent No.: US 11,342,090 B2
(45) Date of Patent: May 24, 2022

(54) BINDER PERMEATED IONIZING RADIATION SHIELDING PANELS, METHOD OF CONSTRUCTION OF IONIZING RADIATION SHIELDING PANELS AND AN X-RAY INSPECTION SYSTEM EMPLOYING SUCH PANELS

(71) Applicant: NORDSON CORPORATION, Westlake, OH (US)

(72) Inventor: Bill Walker, Aylesbury (GB)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 17/257,371

(22) PCT Filed: Aug. 7, 2019

(86) PCT No.: PCT/US2019/045406
§ 371 (c)(1),
(2) Date: Dec. 31, 2020

(87) PCT Pub. No.: WO2020/036777
PCT Pub. Date: Feb. 20, 2020

(65) Prior Publication Data

US 2021/0166828 A1 Jun. 3, 2021

(30) Foreign Application Priority Data

Aug. 14, 2018 (GB) ..... 1813256

(51) Int. Cl.
*G21F 1/12* (2006.01)
*G21F 3/00* (2006.01)
*G21F 7/00* (2006.01)

(52) U.S. Cl.
CPC ..... *G21F 1/12* (2013.01); *G21F 3/00* (2013.01); *G21F 7/00* (2013.01)

(58) Field of Classification Search
CPC ..... G21F 1/12; G21F 3/00; G21F 7/00
(Continued)

(56) References Cited

U.S. PATENT DOCUMENTS

2011/0001065 A1* 1/2011 Popa-Simil ..... G21F 3/00 250/505.1
2014/0166909 A1* 6/2014 Onizawa ..... G21F 1/10 250/515.1
2018/0025799 A1 1/2018 So et al.

FOREIGN PATENT DOCUMENTS

CN 104361919 A 2/2015
CN 206774254 U 12/2017
(Continued)

OTHER PUBLICATIONS

Dage Products; X-ray Inspection Systems; https://www.nordson.com/en/divisions/dage/x-ray-inspection; Nordson Electronics Solutions; accessed Feb. 8, 2021; 3 pages.
(Continued)

*Primary Examiner* — Nicole M Ippolito
(74) *Attorney, Agent, or Firm* — BakerHostetler

(57) ABSTRACT

An ionizing radiation shielding panel comprising a core layer, a first layer on a first side of the core layer and a second layer on a second side of the core layer, opposite to the first side. The core layer comprises radiation attenuation material which may be particles of barite. The first and second layers each comprise a permeable reinforcement structure and each of the first, second and core layers are permeated with a binder. In the construction of the panel, the binder is infected into a mould containing the other constituents of the panel. The ionizing radiation shielding panel can be used in the housing of an x-ray inspection apparatus.

30 Claims, 13 Drawing Sheets

(58) Field of Classification Search
USPC ..... 250/505.1, 506.1, 507.1, 515.1, 516.1, 250/517.1, 518.1, 519.1
See application file for complete search history.

(56) References Cited

FOREIGN PATENT DOCUMENTS

| | | | |
|---|---|---|---|
| CN | 107685495 | A | 2/2018 |
| WO | 2013/040666 | A1 | 3/2013 |

OTHER PUBLICATIONS

ISA/220—Notification of Transmittal or Search Report and Written Opinion of the ISA, or the Declaration dated Oct. 28, 2019 for WO Application No. PCT/US19/045406.

* cited by examiner

BINDER PERMEATED IONIZING RADIATION SHIELDING PANELS, METHOD OF CONSTRUCTION OF IONIZING RADIATION SHIELDING PANELS AND AN X-RAY INSPECTION SYSTEM EMPLOYING SUCH PANELS

CROSS REFERENCE TO RELATED APPLICATIONS

This application is a National Stage Application of International Patent App. No. PCT/US2019/045406, filed Aug. 7, 2019, which claims priority to United Kingdom Patent Application No. 18132563 filed Aug. 14, 2018, the entire disclosures of both of which are hereby incorporated by reference as if set forth in their entirety herein.

FIELD OF THE INVENTION

The invention relates to ionizing radiation shielding panels and particularly to ionizing radiation shielding panels for x-ray inspection systems.

BACKGROUND TO THE INVENTION

Exposure to ionizing radiation can be harmful to humans. Even very low doses can be harmful if the dose is frequent enough. There are many sectors of industry where ionizing radiation is usefully employed, such as the medical, security and electronics industries. There is a need to reduce the exposure to radiation for people who work in these sectors of industry.

A common way of protecting those who work in the vicinity of ionizing radiation sources is to place a barrier between them and the ionizing radiation source. The barrier is designed to absorb as much of the harmful ionizing radiation as possible. The barmier may be a cabinet in which the ionizing radiation source is placed.

The effectiveness of a material at absorbing ionizing radiation can be measured for a specific energy. This measurement is described as an attenuation coefficient. The higher the attenuation coefficient, the better that, material is at absorbing that type and energy of ionizing radiation. Generally, the greater the atomic mass of an element the greater the radiation attenuation coefficient of a material containing that element.

One form of ionizing radiation is x-rays. There are two common ways of constructing x-ray radiation shielding barriers. The first construction comprises lining a cabinet with lead. Lead has a relatively massive nucleus meaning that it has a high radiation attenuation coefficient for x-rays. The second construction uses concrete. The concrete used to form the x-ray radiation shield sometimes contains an amount of a material with a higher radiation attenuation coefficient than normal concrete.

The relatively high radiation attenuation coefficient of lead means that lead-lined barriers can be designed to be relatively thin and still shield a person from receiving harmful doses of x-ray radiation. However, lead radiation barriers have several disadvantages. Lead is very expensive. Barriers comprising lead can be prohibitively expensive for some products and market sectors. Lead is toxic, and its use in many applications has been banned. Lead has a high density and is weak. Barriers cannot be constructed of lead alone, as they would not be able to support their own weight. This means lead-lined barriers require a substantial supporting frame. And the process of lining cabinets with lead is time consuming and expensive. So in industries that still use lead there is a desire to find practical alternatives. X-ray radiation shields using concrete are generally cheaper to construct than lead-lined shields. However, there are also disadvantages to using concrete. Concrete shields are relatively large and heavy and are therefore difficult to transport. To be strong enough to be self-supporting and long-lasting any features made of concrete must be designed to be relatively large. The minimum feature size that can be moulded into concrete is about 50 mm. Concrete x-ray radiation shields therefore cannot have complex or detailed forms. There is a need for x-ray radiation barriers that are inexpensive and easy to construct while not suffering from the disadvantages of either of the common barrier types. There is also a need for an x-ray radiation barrier that can have a more complex and detailed shape than is possible with concrete, with minimum feature sizes of less than 50 mm. It would be desirable to provide a barrier that does not use lead but has a comparable radiation attenuation to existing lead based barriers.

Equally, there is a need for barriers for other forms of ionizing radiation that have the advantages and desirable features as described above in relation to x-ray radiation barriers. An example of another form of ionizing radiation is fast neutrons. It would also be desirable for the ionizing radiation barriers to effectively shield more than one type of ionizing radiation, for example both fast neutrons and x-rays.

SUMMARY OF THE INVENTION

The invention provides an ionizing radiation shielding panel, an ionizing radiation shielding enclosure, a method for producing such an ionizing radiation shielding panel and enclosure, and an x-ray inspection system according to the appended independent claims, to which reference should be made. Preferred or advantageous features of the invention are defined in the dependent claims.

In a first aspect of the invention there is a provided an ion radiation shielding panel comprising a core layer comprising a radiation attenuating material. The radiation shielding panel also comprises a first layer on a first side of the core layer, comprising a permeable reinforcement structure, and a second layer on a second side of the core layer opposite to the first side, comprising a permeable reinforcement structure.

A binder permeates the first layer, second layer and core layer. The binder is a material that can be initially fluid during the manufacturing process but which can then be hardened or solidified. The binder advantageously has a relatively low viscosity making it suitable for permeating through the layers of the radiation shielding panel. The hardened binder advantageously holds the layers together, with the first layer on a first side of the core layer and a second layer on a second side of the core layer. The binder advantageously fully permeates through the first layer, the core layer and the second layer so that the reinforcement structures and the radiation attenuating material are all held within the hardened binder. The binder forms a continuous binder matrix. The first and second layers provide support, strength and rigidity to the core layer together with the binder. The resulting radiation shielding panels are inexpensive and easy to handle. They also do not require any additional support.

The binder may be an adhesive. The binder may be a resin. This resin may be a thermosetting resin, a polyester resin with an accelerator, a UV curable resin or an epoxy resin.

The permeable reinforcement structure of the first or second layers may be any structure through which a fluid such as a binder can permeate or pervade and which provides strength and resilience to the first and second layers. The permeable reinforcement structure may be a fabric, a lattice, a mesh, a perforated sheet or another open pore structure. The permeable reinforcement structure may advantageously be a fabric. The permeable reinforcement structure may comprise glass fibre, or metal filaments, or carbon fibre, or poly-paraphenylene terephthalamide. The permeable reinforcement structure of the first layer or second layer, or both the first layer and the second layer may comprise a woven fibre cloth, randomly orientated chopped fibre strands, or continuous filaments arranged in a mat, or an array of filaments. The first layer or second layer, or both the first layer and the second layer, may comprise two or more sheets of the permeable reinforcement structure. Using two sheets instead of one advantageously provides additional strength to the first layer compared to using only one. The first and second layer are coated with an additional, functional, layer. The functional layer has properties advantageous for the surface of the panel. The functional layer coat may be fire retardant. It may also ensure that the finished product is a consistent colour. The functional layer may prevent electrostatic build up. The functional layer may comprise an electrostatic discharge (ESD) layer. The functional layer may be a gel coat. Alternatively, the functional layer may be a paint. The first and second layer may be coated with multiple functional layers. Each functional layer may have one or more than one function advantageous for the surface of the panel.

The first layer or the second layer, or both the first layer and the second layer, may comprise a binder spreader layer. The binder spreader layer advantageously allows the binder to quickly permeate across the full extent of the surface of the panel. In particular, the binder spreader layer may be configured to cause the binder to travel more quickly in a direction across the core layer than in a direction through the core layer. The binder spreader layer may be positioned between the permeable reinforcement structure and the core layer. The first layer or the second layer, or both the first layer and the second layer, may further comprise a second permeable reinforcement structure positioned between the binder spreader layer and the core layer. This advantageously means that the second layer has a structure with the binder spreader layer positioned between the two permeable reinforcement structure layers. The two permeable reinforcement structure layers help to keep the binder spreader layer separated from the core layer.

The first sheet, second sheet or both sheets of the permeable reinforcement structure of the first or second layer may comprise a mat of chopped fibre strands. This advantageously allows the binder to spread quickly across the second layer in a similar way to the binder spreader layer. It also provides strength to the second layer.

As used herein, ionizing radiation refers to radiation that carries enough energy to liberate electrons from atoms or molecules, thereby ionizing them. Ionizing radiation may be made up of energetic subatomic particles, ions or atoms moving at high speeds (usually greater than 1% of the speed of light), and electromagnetic waves on the high-energy end of the electromagnetic spectrum. Ionizing radiation may be, for example x-rays or fast neutrons.

As used herein, radiation attenuating material means material that can be used to attenuate ionizing radiation, preferably ionizing radiation that is harmful to humans. The choice of radiation attenuating materials may depend on the type of radiation that the ionizing radiation shielding barrier is designed to shield against as each material be more or less effective at attenuating various types of ionizing radiation.

The radiation attenuating material may comprise an element having an atomic mass greater than 47 unified atomic mass units. Such radiation attenuating material is effective at attenuating x-rays. Elements with higher atomic mass have higher radiation attenuating coefficients as a general rule. A radiation attenuating material of greater than 47 unified atomic mass units advantageously has an attenuation coefficient high enough to allow for lightweight x-ray barriers to be formed.

The radiation attenuating material may be barite. Barite can advantageously be used as an alternative to lead to create radiation shielding panels designed to shield against x-rays. Barite is relatively inexpensive and is non-toxic.

The shielding panel may be designed to shield against fast neutron radiation. Materials with an atomic mass of less than 47 uniformed atomic units may be effective at attenuating fast neutrons. The radiation attenuating material may be boron carbide.

The ionizing radiation shielding panel may comprise more than one type of radiation attenuating material. This advantageously allows the effective attenuation of more than one type of ionizing radiation. The ionizing radiation shielding panel may comprise a first radiation attenuating material for shielding x-rays and a second radiation attenuating material for shielding fast neutrons. This may be advantageous if the ionizing radiation shielding panel is designed primarily to shield against fast neutron radiation. Attenuating of fast neutrons generally involves scattering processes. These scattering processes may result the emission of x-rays by the radiation attenuating material. The inclusion of a second radiation attenuating material that attenuates the x-rays avoids the need far an additional and separate x-ray radiation shield. The first radiation attenuating material may be barite and the second radiation attenuating material may be boron carbide.

The radiation attenuating material may be particulate and may be an aggregate or powder. This advantageously allows the binder to permeate between particles of the aggregate in the production of the ionizing radiation attenuation panel. The binder is therefore able to penetrate through the core layer. The binder then holds all the particles of the radiation attenuation material in the core together as a solid structure. Particulate in this context means in the form of small, separate particles.

Advantageously, the diameter of the largest particle of the radiation attenuating material aggregate is not greater than 10% of the thickness of the core layer. Using only particles of aggregate under a certain size ensures that the concentration of aggregate to binder is uniform throughout the core layer. If particles that are too large are used, then some regions of the core layer may be dominated by these larger particles and comprise very little binder. The surrounding regions may have a higher binder concentration. Regions with higher binder concentration have lower attenuation coefficient and vice versa. The diameter of the largest particle of the radiation attenuating material can be ensured to be below a desired size by passing the radiation attenuating material through a sieve having a controlled hole size.

Regions with large particles could form structurally weak points in the core, as the binder is in low concentration in these areas. Smaller particles advantageously have more surface area per unit volume. This means there is more surface area for the binder to contact. All the particles having a diameter of less than 10% of the thickness of the core layer advantageously results in the core being held together strongly.

Regions near large particles that have higher binder concentration could allow radiation pathways through the core layer here the radiation passes through very little radiation attenuating material. These radiation pathways could allow radiation to pass through the core at dangerous levels. All the particles having a diameter of less than 10% of the thickness of the core layer advantageously results in the radiation attenuating material aggregate being more uniformly distributed through the core layer and so avoiding pathways of low absorption.

The greater the density of radiation attenuating material in the core, the thinner the core layer can be while providing the required amount of radiation shielding. However, the binder must be able to permeate through the core. The particulate radiation attenuating material may comprise particles with a range of sizes. Providing a core layer comprising particles of various size may improve the permeation of the binder through the core layer to provide high packing ratios of radiation attenuating material to binder. In other words, this allows for a high density of radiation attenuating material. Between 75% and 50% of the particles may have a size that falls in the lower $50^{th}$ percentile of the range of particle size. The largest particle size may have a diameter of less than 10% of the thickness of the core layer. The radiation attenuating material may comprise greater than 65% of the core layer by volume. The radiation attenuating material may comprise up to 90% of the core layer by mass. The radiation attenuating material is typically less expensive than the binder. Having a high percentage of radiation attenuating material therefore also means that the cost of producing the shielding panel is lower.

The radiation attenuating coefficient of the core is governed by the density of the radiation attenuating material in the core. Higher concentrations of radiation attenuating material in the core allow the core layer to be thinner while providing comparable radiation shielding. This allows for the overall thickness and mass of radiation shielding panel to be minimised. The ionizing radiation shielding panel may be self-supporting. This means that the panel is strong enough to support its own weight without the need for further mechanical load distribution structures. The radiation shielding panel is advantageously strong enough to withstand additional applied forces. These forces may be exerted by other panels or by features of the panel such as a door. These forces may be exerted by additional mechanical elements fastened to the panels. These forces may also be exerted by a user or during transportation of the panel.

The ionizing radiation shielding panel may further comprise an additional radiation shielding layer. This additional radiation shielding layer may be positioned between two of the layers of the radiation shielding panel. For example, the additional radiation shielding layer may be between the core layer and first reinforcement layer. Alternatively, the additional radiation shielding layer may be between the core layer and the second reinforcement layer. The additional radiation shielding layer may be positioned between the first or second reinforcement layer and the additional functional layer. The additional radiation shielding layer advantageously allows non ionizing radiation to be shielded by the ionizing radiation shielding panel. The additional radiation shielding layer may be configured to shield low-frequency electromagnetic radiation. Low-frequency electromagnetic radiation is commonly emitted by electronic apparatus and may interfere with other instruments and appear as noise. It is therefore advantageous for the ionizing radiation shielding panel to block this radiation. The additional radiation shielding layer may be an electrically conductive mesh.

The ionizing radiation shielding panel may also comprise a mechanical load distribution structure. The mechanical load distribution structure may comprise a component with higher yield stress than the core layer. Fasteners can be connected to the ionizing radiation shielding panel. These fasteners may be connected to the mechanical load distribution structure. The mechanical load distribution structure can advantageously provide a strong point of contact for fasteners and may effectively distribute load, which allows for a strong and robust connection to be made between the ionizing radiation shielding panel and the fasteners. For example, if it is required that a feature such as a door is connected to the ionizing radiation shielding panel then the mechanical load distribution structure can provide a strong point of contact for a hinge of that door to connect to.

The mechanical load distribution structure may be made of metal, such as steel. The mechanical load distribution structure may be made of sheet metal. The mechanical load distribution structure may be positioned between the first layer and core layer. The mechanical load distribution structure may be positioned between the second layer and the core layer. The mechanical load distribution structure may be within the core layer or pass from one side of the core layer to the other. The mechanical load distribution structure may comprise at least one hole through which binder can permeate. The at least one hole advantageously means that the mechanical load distribution structure does not prevent permeation of the binder between the layers of the panel. Alternatively, the mechanical load distribution layer may be positioned on the exterior of the panel. In that case the mechanical load distribution layer may be adhered to the binder. The mechanical load distribution structure may extend across a major part of the ionizing radiation shielding panel. This advantageously means that any forces applied at the point of contact between a fastener and the ionizing radiation shielding panel are spread across a major part of the panel.

The ionizing radiation shielding panel may further comprise features with dimensions smaller than 50 mm and advantageously smaller than 12 mm. These features may have a minimum dimension of 3 mm. Features of these dimensions advantageously allow the radiation shielding panel to have a more complex shape. For example, the radiation shielding panel may be configured to fit against one or more other radiation shielding panels having the same or similar construction. The fitting together of the panels may involve interlocking features of one panel with another. Those interlocking features may have a dimension of less than 50 mm. Panels may advantageously fit together to form a cabinet in which an ionizing radiation source can be placed. This advantageously means that a radiation shielding cabinet can be shipped flat-packed. The panels may then be fitted together on-site. This makes shipping easier.

The ionizing radiation shielding panel array comprise one or more features that allow a labyrinth seal to be formed when joined to another panel. Interlocking of features may create a labyrinth seal between two adjacent panels. The labyrinth seal advantageously prevents radiation shine paths between the two panels that would allow ionizing radiation from the ionizing radiation source to escape. The ionizing radiation source may be an x-ray source.

In a second aspect of the invention, there is provided an enclosure comprising a plurality of ionizing radiation shielding panels in accordance with the first aspect of the invention. The enclosure may comprise panels having one or more features that allow a labyrinth seal to be formed when joined to another panel. These features may have at least one dimension smaller than 50 mm and advantageously smaller than 12 mm.

In a third aspect of the invention there is provided a method fir producing an ionizing radiation shielding panel, comprising:

placing a first layer comprising a permeable reinforcement structure into a mould;

depositing particulate radiation attenuating material into the mould on top of the first layer;

placing a second layer comprising a permeable reinforcement structure into the mould;

closing the mould;

injecting binder into the mould from at least one binder port;

establishing a pressure difference across the mould between at least one binder port and at least one outlet port, such that when the binder is injected into the mould the binder is drawn from the at least one binder port to the at least one outlet port and permeates the first layer, the radiation attenuating material and the second layer in the mould; and hardening the binder.

Preferably, the step of establishing a pressure difference across the mould comprises establishing a partial or full vacuum within the mould. Preferably, the step of establishing a partial or full vacuum within the mould is taken prior to injecting the binder into the mould. It is advantageous that the particulate radiation attenuating material is deposited in the mould in isolation from the binder and that the binder then permeates into that material rather than mixing the two together and pouring the mixture into a mould. This is because it allows for much higher concentrations of radiation attenuating material to be used. The mixture of radiation attenuating material and binder may not be pourable when the concentration of radiation attenuation material is high. The mould can include features with a minimum dimension of less than 50 mm and the particulate radiation attenuating material and binder will uniformly fill those features. These features can be very fine details with a minimum feature size of as small as 3 mm.

The injection of binder into the mould after the radiation attenuation material has been placed in the mould also has the advantage that the binder is processed in a sealed environment. Some binder materials may out gas toxic solvents and so processing in a sealed environment allows simple control of these volatile solvents. There is also no need to have a separate mixer for the radiation attenuation material and binder which would require further processing steps such as cleaning.

The particulate radiation attenuating material may be a powder or an aggregate.

The inclusion of the first and, second layers in the mould, which are also permeated with binder, advantageously creates a structure with radiation attenuating material between the first and second layers all held together by the binder once the binder is hardened. The first and second layer, and particularly the permeable reinforcement structure of the first and second layer, advantageously provide support, strength and rigidity to the structure. This allows a very high density of radiation attenuating material to be used while still providing sufficient mechanical strength and toughness.

The at least one binder port may be on an opposite side of the mould to the at least one outlet port. This advantageously ensures that the binder is drawn through everything that is in the mould. A solid structure held together with continuous binder is formed once the binder is hardened.

The permeable reinforcement structure of the first, and second layers may comprise glass fibre, or metal filaments, or carbon fibre, or poly-paraphenylene terephthalamide. These fabrics may have a fibrous structure that advantageously allows binder to pass through them as binder is drawn through the mould from the binder port to the outlet port.

The permeable reinforcement structure of the first or second layers may be any structure through which a fluid such as a binder can permeate or pervade and which provides strength and resilience to the first and second layers. The permeable reinforcement structure may be a fabric, a lattice, a mesh, a perforated sheet or another open pore structure. The permeable reinforcement structure may advantageously be a fabric. The permeable reinforcement structure may comprise glass fibre, or metal filaments, or carbon fibre, or poly-paraphenylene terephthalamide. The permeable reinforcement structure of the first layer or second layer, or both the first layer and the second layer may comprise a woven fibre cloth, randomly orientated chopped fibre strands, or continuous filaments arranged in a mat, or an array of filaments. The first layer or second layer, or both the first layer and the second layer, may comprise two or more sheets of the permeable reinforcement structure. Using two sheets instead of one advantageously provides additional strength to the first layer compared to using only one.

The first and second layer may be coated with an additional, functional, layer. The functional layer has properties advantageous for the surface of the panel. The functional layer coat may be fire retardant. It may also ensure that the finished product is a consistent colour. The functional layer may prevent electrostatic build up. The functional layer may comprise an electrostatic discharge (ESD) layer. The functional layer may be a gel coat. Alternatively, the functional layer may be a paint. The first and second layer may be coated with multiple functional layers. Each functional layer may have one or more than one function advantageous for the surface of the panel.

The first layer or the second layer, or both the first layer and the second layer, may comprise a binder spreader layer. The binder spreader layer advantageously allows the binder to quickly permeate across the full extent of the surface of the panel. This advantageously means that the binder is permeated uniformly across the entire second layer and reaches the outside edges furthest from the binder input port. The binder spreader layer may be configured to cause the binder to travel more quickly in a direction across the core layer than in a direction through the core layer. The ratio of the speed of travel of the binder in the binder spreader layer in a direction across the core layer to the speed of travel of the binder through the core layer may be matched to the ratio of the distance between the binder port and the outlet port in a direction across the panel to the thickness of the panel.

The binder spreader layer may be positioned between the permeable reinforcement structure and the core layer. The first layer or the second layer, or both the first layer and the second layer, may further comprise a second permeable reinforcement structure positioned between the binder spreader layer and the core layer. This advantageously means that the second layer has a structure with the binder spreader layer positioned between the two permeable reinforcement structure layers. The two permeable reinforcement structure layers help to keep the binder spreader layer separated from the core layer.

The binder spreader layer of the second layer is positioned between the at least one binder port and at least one permeable reinforcement structure layer. This advantageously provides a better interface for the radiation attenuation material than if the binder spreader layer were directly in contact with the radiation attenuation material. In that case the radiation attenuation material might otherwise affect the flow and spread of the binder in the binder spreader layer.

The method for producing the ionizing radiation shielding panel may further comprise compressing the radiation attenuating material prior to the step of injecting the binder. The step of compressing may be carried out by performing the step of closing the mould. This advantageously ensures that the radiation attenuating material takes up as little space as possible and the final ionizing radiation shielding panel can be made as thin as required. Compressing the radiation attenuating material may also be achieved by tamping or using compression rollers.

The step of establishing a pressure difference may comprise applying a vacuum pressure or a pressure below atmospheric pressure, to the outlet port. Applying a vacuum pressure or a pressure below atmospheric pressure may prevent dry areas or areas free of binder forming in the panels. In other words, applying a vacuum pressure or pressure below atmospheric pressure may ensure that the binder uniformly permeates across the full extent of the radiation shielding panel. The pressure below atmospheric pressure may be between 50000 Pa and 100000 Pa below atmospheric pressure.

Alternatively, or in addition, the step of establishing a pressure difference may comprise injecting the binder through the binder port at a pressure above atmospheric pressure. The step of establishing a pressure difference may comprise injecting the binder through the binder port at a pressure of between 50000 Pa and 400000 Pa above atmospheric pressure. The optimum pressure may depend on the thickness of the panel. For thick panels this may be up to 400000 Pa. An applied pressure advantageously speeds up the permeation process and ensures the binder reaches all regions of the mould, even those at the greatest distance from the binder port. The amount of pressure that is desirable depends on the area of the panel that is being constructed, the number of binder ports and the maximum distance between a point on the surface of the panel and its closest binder port. The greater the distance between ports, the greater the pressure that is required. A pressure of between 50000 and 200000 Pa above atmospheric pressure may be used for most panels. The pressure is advantageously selected to maximise flow rate without undesirably disturbing the radiation attenuation material. If the permeation of the resin is much faster than this it can result in disturbance of the radiation attenuation material, resulting in an uneven distribution of the radiation attenuation material.

Preferably, the step of establishing a pressure difference comprises both applying a vacuum pressure or a pressure below atmospheric pressure and injecting the binder through the binder port at a pressure above atmospheric pressure. This may ensure that the flow rate is maximised while also preventing dry or binder free areas from developing in the panel. The pressure difference may be at least 100000 Pa.

The binder from the at least one binder port may be injected into a channel running around a periphery of the mould. This advantageously means that binder permeates the layers from all sides rather than from a single point. This again has the advantage of speeding up the permeation process and ensuring the binder reaches all regions of the mould, even those at the greatest distance from the binder port.

The method for producing the ionizing radiation shielding panel may further comprise treating the mould with a release agent before the first fibre layer is inserted into the mould. This advantageously allows easy removal of the ionizing radiation shielding panel after the binder has been hardened. It may also comprise applying an additional functional layer to the surface of the mould. The additional functional layer may be a gel coat layer. The gel layer coat may be fire retardant.

In some embodiments, a portion of the mould comprises a flexible sheet. This means that a portion of the mould is collapsible. The flexible sheet is preferably positioned on a side opposite to the outlet port. The flexible sheet may compress the core layer when a pressure below atmospheric pressure is applied to the outlet port. A plurality of binder ports may be provided in the flexible sheet. The flexible sheet may be disposed of after the panel is formed or may remain part of the finished panel.

In some embodiments a first portion of the mould may form part of the ionizing radiation shielding panel. The first portion of the mould may be adhered to the binder. The first portion of the mould may form an exterior layer of the ionizing radiation shielding panel and may provide fixing points on the panel. The first portion of the mould may also provide a load distribution function and/or a cosmetic function. The first layer, particulate radiation attenuating material and second layer may all be placed in the first portion of the mould. No release agent is applied to the first portion of the mould so that the binder adheres to the first portion of the mould. The step of closing the mould may comprise fixing a flexible sheet over the first portion of the mould, the flexible sheet forming a second portion of the mould.

In a fourth aspect of the invention there is a provided an x-ray inspection apparatus comprising:

a housing, an x-ray source, an x-ray detector, and a support for objects to be imaged, the support being positioned between the x-ray source and the x-ray detector;

wherein the housing comprises one or more walls, wherein at least a portion of the one or more walls comprises:

a core layer comprising a radiation attenuating material, a first layer comprising a permeable reinforcement structure, on a first side of the core layer, a second layer comprising a permeable reinforcement structure, on a second side of the core layer, opposite to the first side;

wherein the first layer, second layer and core layer are permeated with a binder.

The binder advantageously fully permeates the first layer, second layer and core layer so that the permeable reinforcement structures and the radiation attenuating material are held within the binder. The binder forms a continuous binder matrix.

The portion of the one or more walls that comprises radiation attenuating material advantageously reduces radiation passing through that portion to a level that is safe for users in the vicinity of the x-ray inspection apparatus.

Each of the walls may comprise: a core layer comprising a radiation attenuating material, a first layer comprising a permeable reinforcement structure, on a first side of the core layer, and a second layer comprising a permeable reinforcement structure, on a second side of the core layer, opposite to the first side; wherein the first layer, second layer and core layer are permeated with a binder. The one or more walls may completely enclose the x-ray source.

The walls may comprise a roof panel.

The walls may comprise a floor panel.

A complete cabinet, room or other containment of the radiation emission source may be formed by walls of the housing. This could be shipped in flat-pack form and then fitted together on site to create a shield in three dimensions which advantageously improves ease of shipping.

The permeable reinforcement structure of the first and second layers may comprise glass fibre, or metal filaments, or carbon fibre, or poly-paraphenylene terephthalamide.

The permeable reinforcement structure of the first second layers may be any structure through which a fluid such as a binder can permeate or pervade and which provides strength and resilience to the first and second layers. The permeable reinforcement structure may be a fabric, a lattice, a mesh, a perforated sheet or another open pore structure. The permeable reinforcement structure may advantageously comprise a fabric. The permeable reinforcement structure of the first layer or second layer, or both the first layer and the second layer may comprise a woven fibre cloth, randomly orientated chopped fibre strands, or continuous filaments arranged in a mat, or an array of filaments. The first, layer or second layer, or both the first layer and the second layer, may comprise two or more sheets of the permeable reinforcement structure. The first and second layer are coated with an additional, functional, layer. The functional layer has properties advantageous for the surface of the panel. The functional, layer coat may be fire retardant. It may also ensure that the finished product is a consistent colour. The functional layer may prevent electrostatic build up. The functional layer may comprise an electrostatic discharge (ESD) layer. The functional layer ma be a gel coat. Alternatively, the functional layer may be a paint. The first and second layer may be coated with multiple functional layers. Each functional layer may have one or more than one function advantageous for the surface of the panel.

The first layer or the second layer, or both the first layer and the second layer, may comprise a binder spreader layer. The binder spreader layer may be positioned between the permeable reinforcement structure and the core layer. The first layer or the second layer, or both the first layer and the second layer, may further comprise a second permeable reinforcement structure positioned between the binder spreader layer and the core layer. This advantageously means that the second layer has a structure with the binder spreader layer positioned between the two permeable reinforcement structure layers. The two permeable reinforcement structure layers help to keep the binder spreader layer separated from the core layer. The radiation attenuating material of the one or more walls may comprise between 65-90% of the binder core layer by volume. The radiation attenuating material of the one or more walls may comprise up to 90% of the core layer by mass. The radiation attenuating material of the one or more walls may comprise an element having an atomic mass greater than 47 unified atomic mass units. The radiation attenuating material of the one or more walls may be barite. The radiation attenuating material may be particulate. The particle may be a range of sizes. Between 75% and 50% of the particles may have a size that falls in the lower $50^{th}$ percentile of the range of particle size. The diameter of the largest particle of the radiation attenuating material of the one or more walls may be no more than 10% of the thickness of the core layer of the one or more walls.

The one or more walls may further comprise an additional radiation shielding layer. The additional radiation shielding layer of the one or more walls may be configured to shield low-frequency electromagnetic radiation. The additional shielding layer of the one or more walls may be an electrically conductive mesh.

X-ray radiation shielding panels, according to the invention, have the advantages of being stronger, cheaper than existing radiation shields and allows more complicate and refined designs of panel.

It should be clear that features described in relation to one aspect may be applied to other aspects of the invention. Particularly, features in relation to the first aspect can apply to the one or more walls of the third aspect.

BRIEF DESCRIPTION OF THE DRAWINGS

Embodiments in accordance with the invention will now be described, by way of example only, with reference to the accompanying drawings, in which.

DETAILED DESCRIPTION

Figure 1:
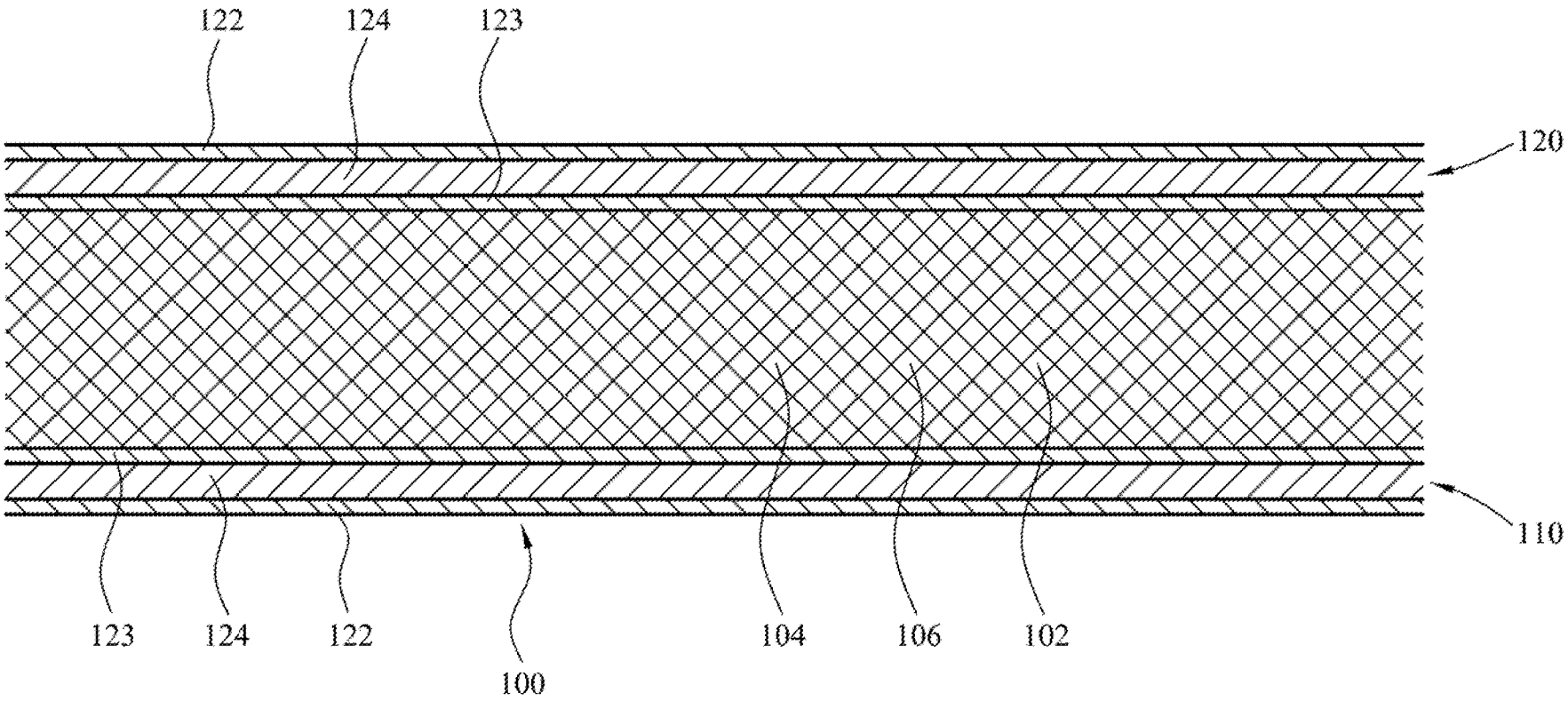
FIG. 1 is a cross-sectional view of a portion of an x-ray radiation shielding panel in accordance with the invention.

FIG. 1 is a cross-sectional view of an x-ray shielding panel 100 for use in an x-ray inspection apparatus. The radiation shielding panel comprises a core layer 102, a first layer 110 and a second layer 120. The core layer 102 is sandwiched between the first layer 110 and the second layer 120. The core layer comprises an aggregate of radiation attenuating material 104 which, in this example, is an aggregate of barite.

A binder 106 is present through all of the layers of the radiation shielding panel 100. The binder 106 is a resin that has been hardened during the manufacture process. In this example, the binder is a Sicomin™ 8100 epoxy resin. The hardened resin holds the layers of the radiation shielding panel 100 together. The first and second layers provide support to the core layer.

The aggregate of barite 104 comprises particles of various sizes. The aggregate is chosen, or processed, to ensure that the maximum size of a barite particle is no more than 10% of the thickness of the core layer. This can be achieved by passing the radiation attenuating material through a sieve having a controlled hole size. In this example, the thickness of the core layer is 20 mm. This means that the maximum size of the barite particles is 2 mm. There is no minimum particle size. This ensures that there is a relatively even distribution of barite throughout the core layer 102 and, in particular, that there is a minimum path length of barite that radiation must pass through when traversing the panel. The resin 106 makes up only 25% of the core layer 102 by volume, with the rest of the core layer 102 being the aggregate of barite 104.

The first layer 110 and the second layer 120 are both layers of Polymat™ Free Flow, available from Scott and Fyfe, Tayport Works, Lint Road, Tayport, Fife, Scotland, UK. The Polymat™ Free Flow layers comprise two glass fibre chopped strand mats 122, 123 as well as a binder spreader layer or resin spreader layer 124 formed by a polypropylene needle bonded core, positioned between the two mats of chopped glass fibre strands 122, 123. Resin 106 fills the gaps between the fibre of the mats as well as permeating the resin spreader layer 124. For each of the first and second Polymat™ layers, the outer mat of chopped glass fibre strands 122 forms an outer layer for the radiation shielding panel. The surface of the mat of chopped glass fibre strands, permeated with resin, is coated with a gel coat layer (not shown). The gel coat layer provides fire retardancy. It also ensures that the finished product is a consistent colour.

Figure 2:
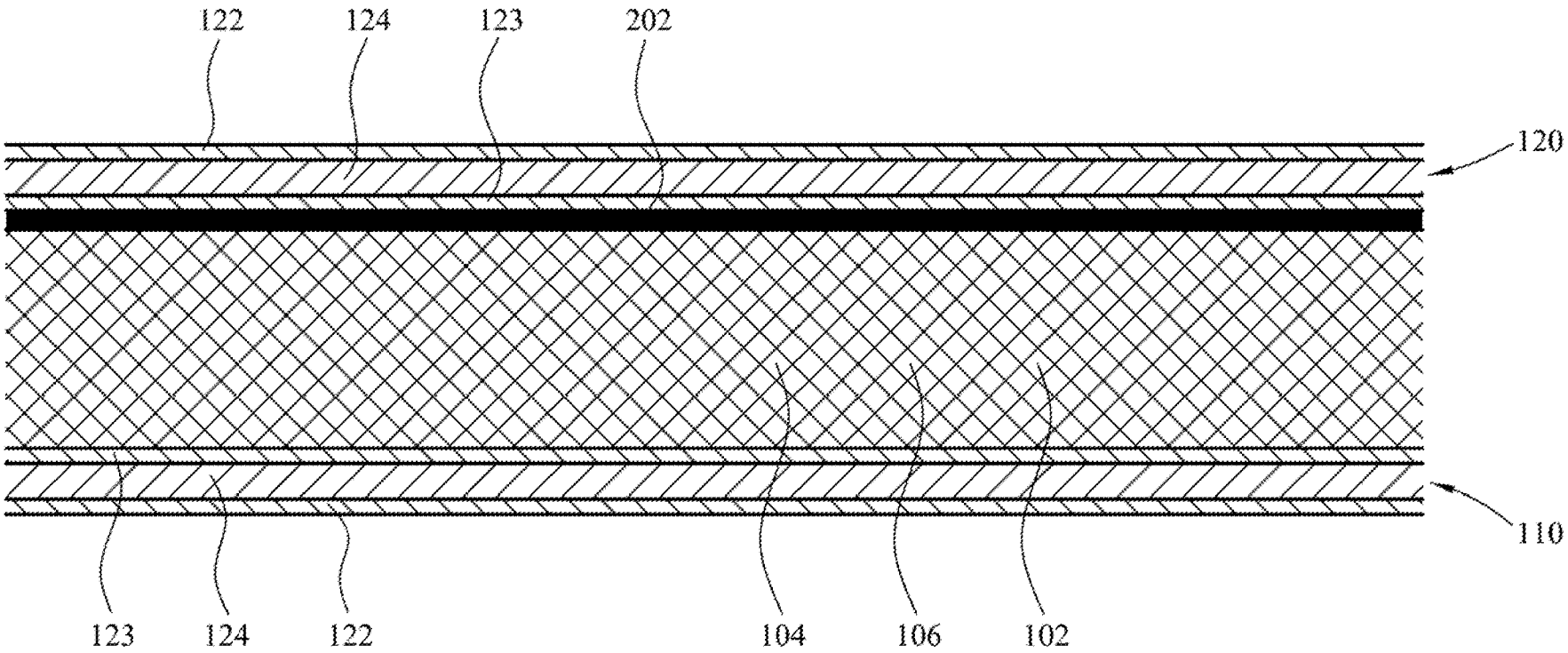
FIG. 2 is a cross-sectional view of another embodiment of the x-ray radiation shielding panel comprising an additional layer.

The radiation shielding panel may comprise at least one other additional layer. Additional layers may be positioned between any of the layers already described above. FIG. 2 is a cross-sectional view of an embodiment of the radiation shielding panel of FIG. 1 comprising an additional layer 202. The additional layer, in this example, is positioned between the Polymat™ Free Flow layer 120 and the core layer 106.

In one embodiment, the additional layer 202 is a radiation shielding layer which takes the form of an electrically conductive mesh. This radiation shielding layer is configured to reflect the low-frequency electromagnetic radiation that is often emitted by electronic machinery.

In another embodiment, the additional layer 202 is a mechanical load distribution structure layer. The mechanical load distribution structure layer may be provided instead of, or in addition to, the radiation shielding layer for reflecting low-frequency electromagnetic radiation.

Figure 3:
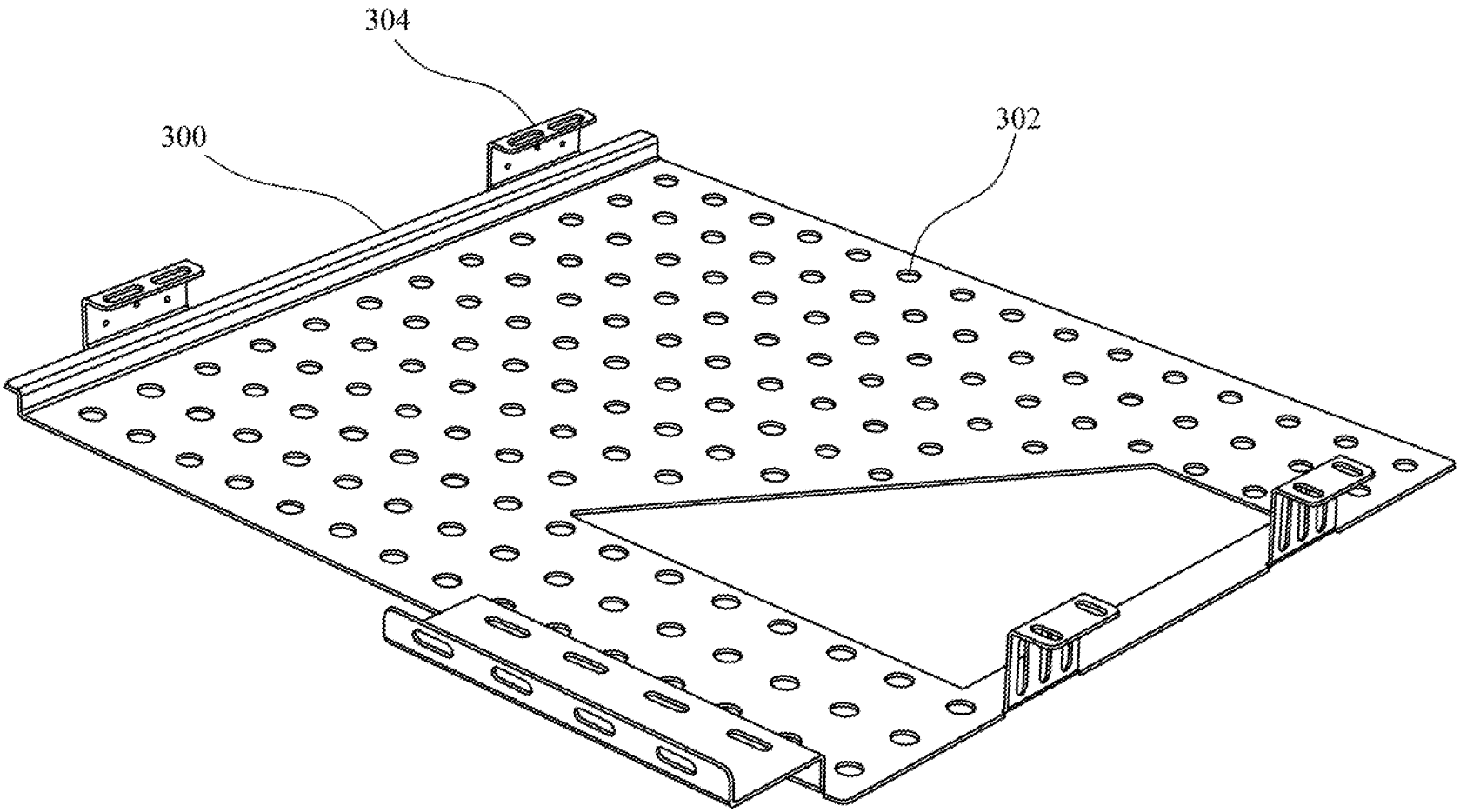
FIG. 3 is a perspective view of mechanical load distribution structure that could form an additional mechanical load distribution layer of the x-ray radiation shielding panel.
Figure 4:
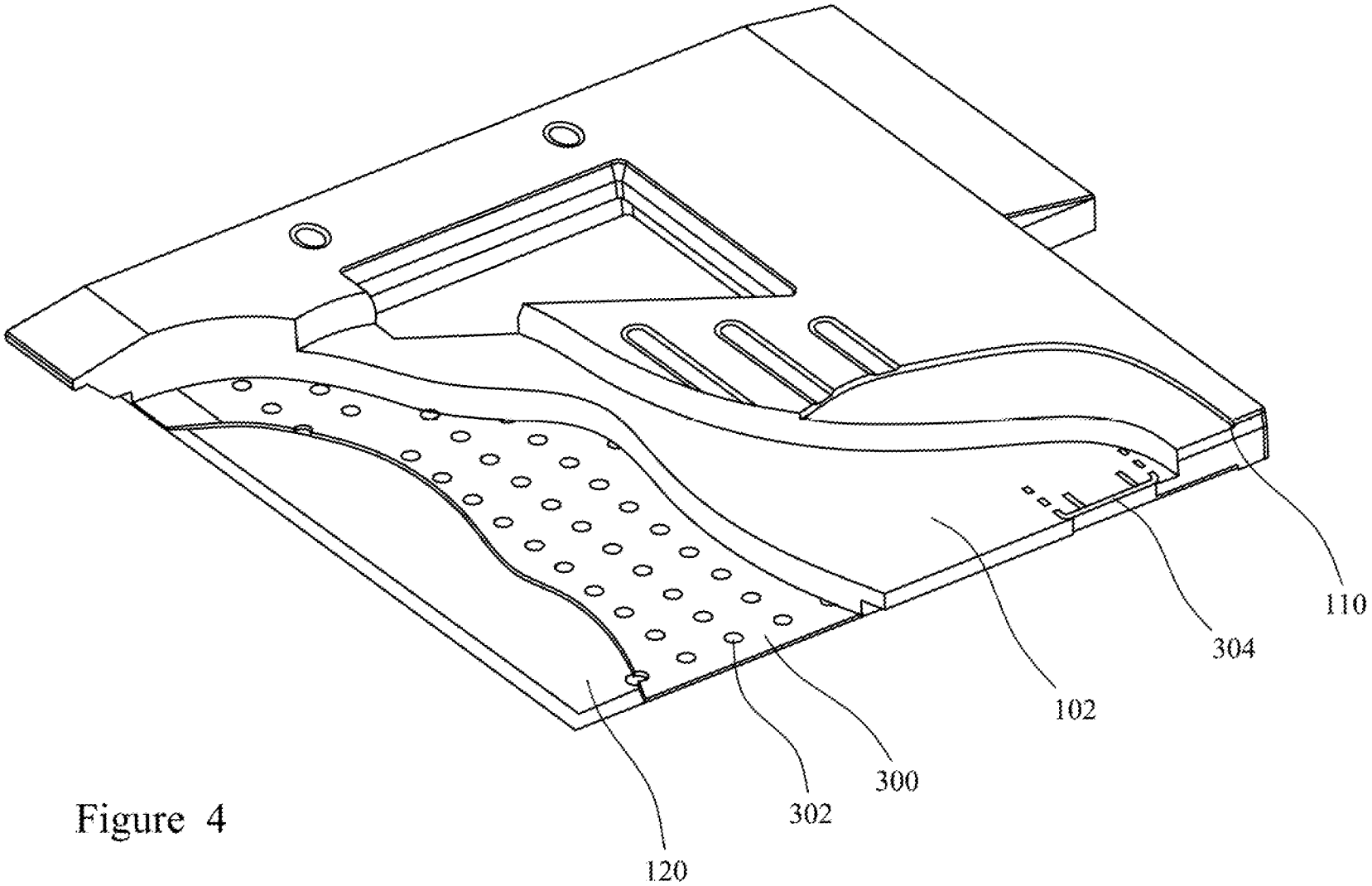
FIG. 4 is a perspective view of a cutaway x-ray radiation shielding panel showing particularly the mechanical load distribution structure as an additional layer in the x-ray radiation shielding panel.

An example mechanical load distribution structure 300 is shown separately to the panel in FIG. 3 and then as part of a panel in FIG. 4, which is a cutaway perspective view of the radiation shielding panel. The mechanical load distribution structure 300 is made from sheet steel.

Figure 5:
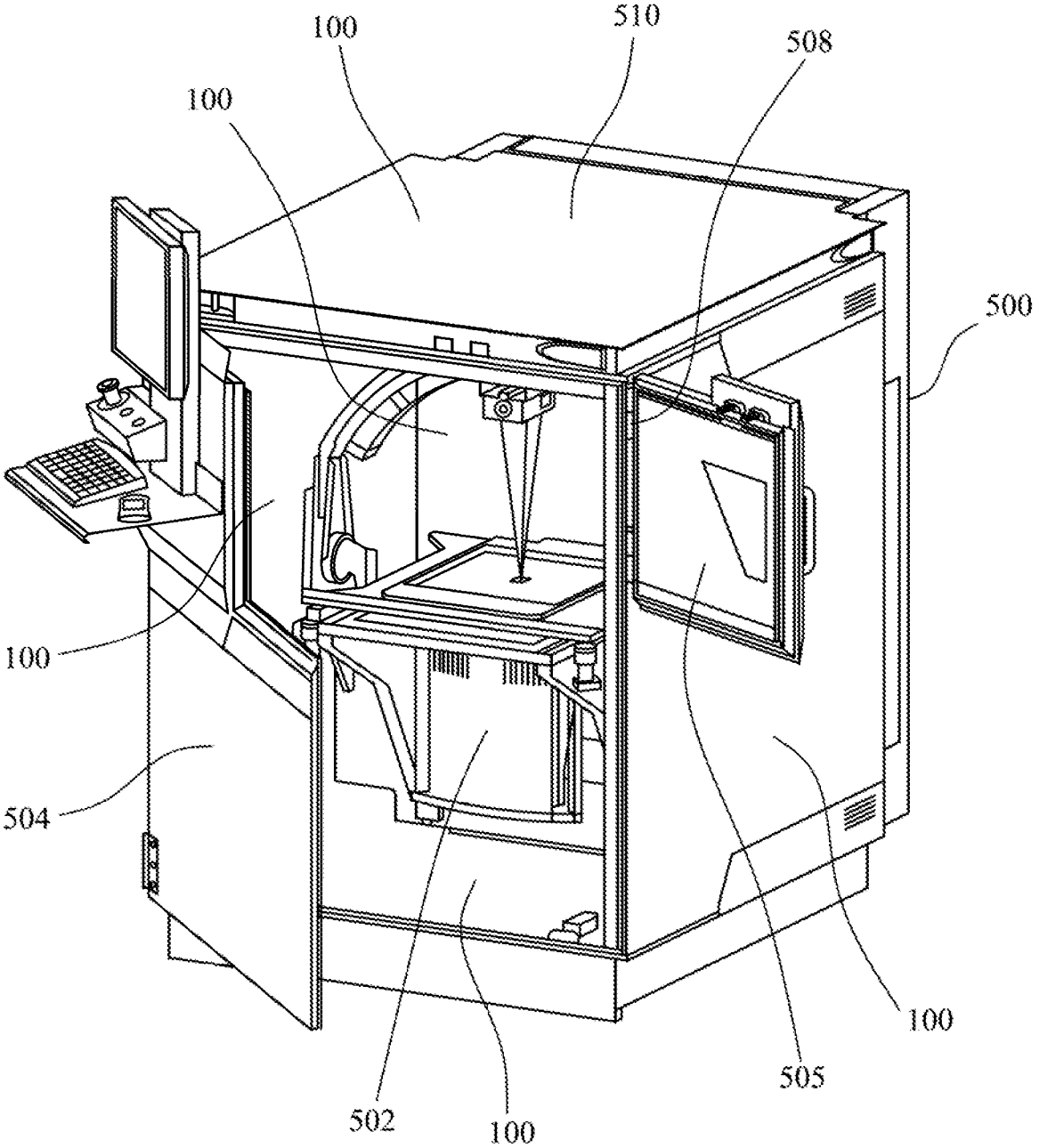
FIG. 5 is a perspective view of an x-ray inspection apparatus comprising a radiation shielding cabinet formed of x-ray shielding panels in accordance with the invention.

The mechanical load distribution structure comprises a number of holes 302. These holes allow resin to pass through the mechanical load distribution structure into adjacent layers. The mechanical load distribution structure also comprises features 304. The purpose of features 304 will be described below in relation to an x-ray cabinet as shown in FIG. 5. The aggregate of barite covers the mechanical load distribution structure such that the features oldie mechanical load distribution structure are covered. This can be seen in FIG. 4.

An x-ray cabinet for holding an x-ray source can be formed from a plurality of panels of this type. This is shown in FIG. 5. The radiation shielding panels 100 form the walls, roof and floor of the cabinet. An x-ray source 502, which is part of an x-ray inspection system, is shown within the cabinet 500. The x-ray source is part of a system and apparatus for inspecting electronics, such as the Dage Quadra range available from http://www.nordson.com/en/divisions/dage/x-ray-inspection.

Five of the sides of the cabinet are made of single x-ray radiation shielding panels 100. The front face of the cabinet 500 has a door arrangement which comprises two x-ray radiation shielding panels 504 and 505. The panels 504 and 505 have a different size and shape to the other five x-ray radiation shielding panels. The two panels 504 and 505 are attached to different side panels using hinges 508 attached to the respective panels. Panel 504 has a lip which interlocks with panel 505 when the doors close. A labyrinth seal is formed between the two panels when the doors are closed. The cabinet shown in FIG. 5 has external casing elements on some of the panels. For example, casing 510 is shown on top of the top panel 100. The external casing covers the wiring and other electronics required for the control of the x-ray inspection system.

Figure 6:
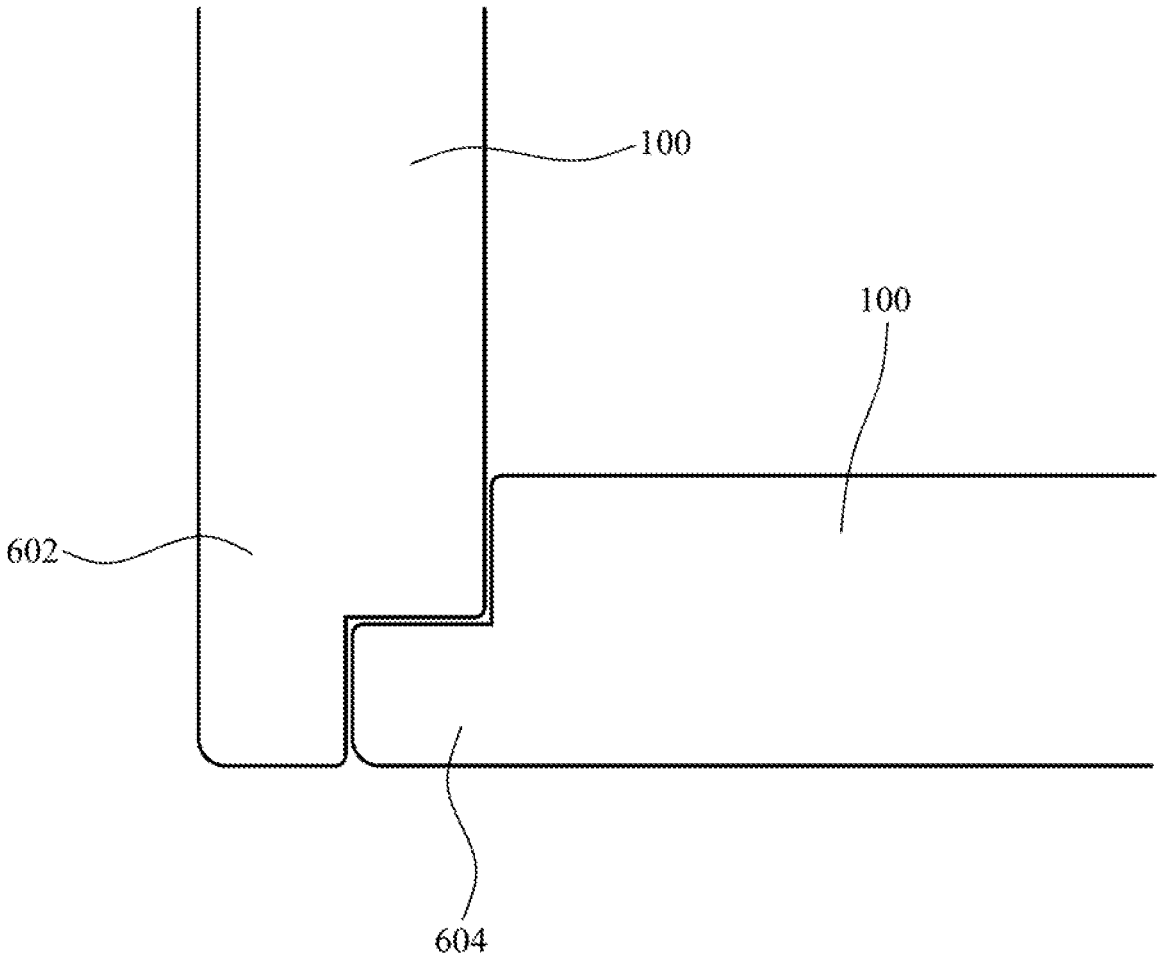
FIG. 6 is a cross-sectional view of two x-ray radiation shielding panels adjacent to one another.

X-ray radiation shielding panels 100 can be manufactured to have features which aid the assembly and improve the construction of the cabinet. X-ray radiation shielding panels used to construct the cabinet may be manufactured with a lip on their outside edges. The lips of adjacent panels at right angles interlock. FIG. 6 shows a cross-sectional schematic view of two panels with lips 602 and 604 interlocking. This interlocking forms a labyrinth seal. The labyrinth seal prevents any line of sight radiation paths between the two panels or radiation paths through lower quantities of radiation attenuating material.

The individual panels 100 that form the sides of the cabinet and the two door parts are held together using fasteners. These fasteners are connected to the panel after the panel has been manufactured. The fasteners are used to hold the various x-ray radiations shielding panels 100 of the cabinet together in an interlocking relationship, and include features such as the door hinges for panels 504 and 505.

Fasteners needing to withstand low loads, such as fasteners holding two adjacent sides of the cabinet together, can connect to any of the resin permeated layers of the x-ray radiation shielding panel. However, some connections, such as hinges, need to withstand higher loads. X-ray radiation shielding panels 100 comprising a mechanical load distribution structure, as shown in FIGS. 3 and 4, allow for connection of fasteners that need to withstand higher loads. The mechanical load distribution structure provides a strong point of contact and distributes the load. This allows for a strong and robust connection to be made between the x-ray radiation shielding and fastener. An example of such a fastener is a hinge, such as the hinge 508 of FIG. 5. The hinge is attached such that it is connected to the mechanical load distribution structure.

The mechanical load distribution structure 300, shown in FIGS. 3 and 4, is shaped to accommodate the type of fasteners required. An example of this is feature 304, which is a fixing point to which hinges can be fixed. The fixing point extends perpendicular to plane of the panel 100. As can be seen in FIG. 4, the fixing point 304 is on the edge of the panel for attachment of a hinge, such as hinge 508 of FIG. 5. The hinge 508 is attached to the panel 100 through the fixing point 304. External forces caused by anything attached to the hinge, such as a door or door part, is then spread through the mechanical load distribution structure 300 from the fixing point 304.

Figure 7:
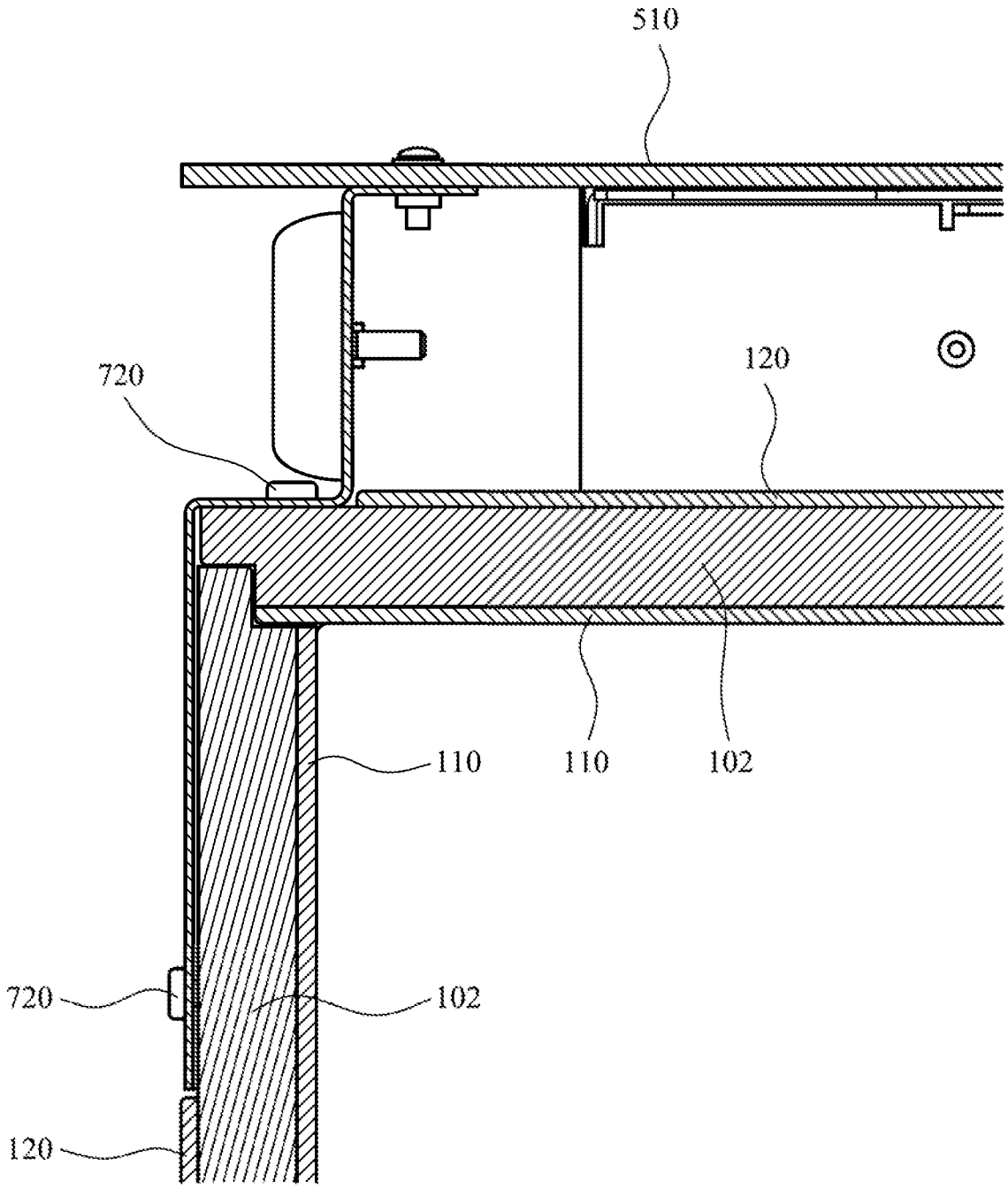
FIG. 7 is a cross-sectional view of two adjacent x-ray radiation shielding panels adjacent to one another in the context of the radiation shielding cabinet of FIG. 5.

FIG. 7 illustrates the junction between a sidewall panel and the roof panel of the cabinet of FIG. 5. The two panels have the same lip structure as shown in FIG. 6. Each of the panels comprises a first layer 110, a core layer 102 and a second layer 120. Each first layer extends across the full extent of core layer of both panels. However, the second layer of each panel only extends across apart of each core layer. This allows for the attachment of metal casing structure 510 in a manner that provides for a flush finish. The metal casing structure is fixed to the panels using screw fixings 720. The junction between the two panels thus provides a labyrinth seal, preventing the escape of x-rays, as well as an aesthetically pleasing finish.

Figure 8:
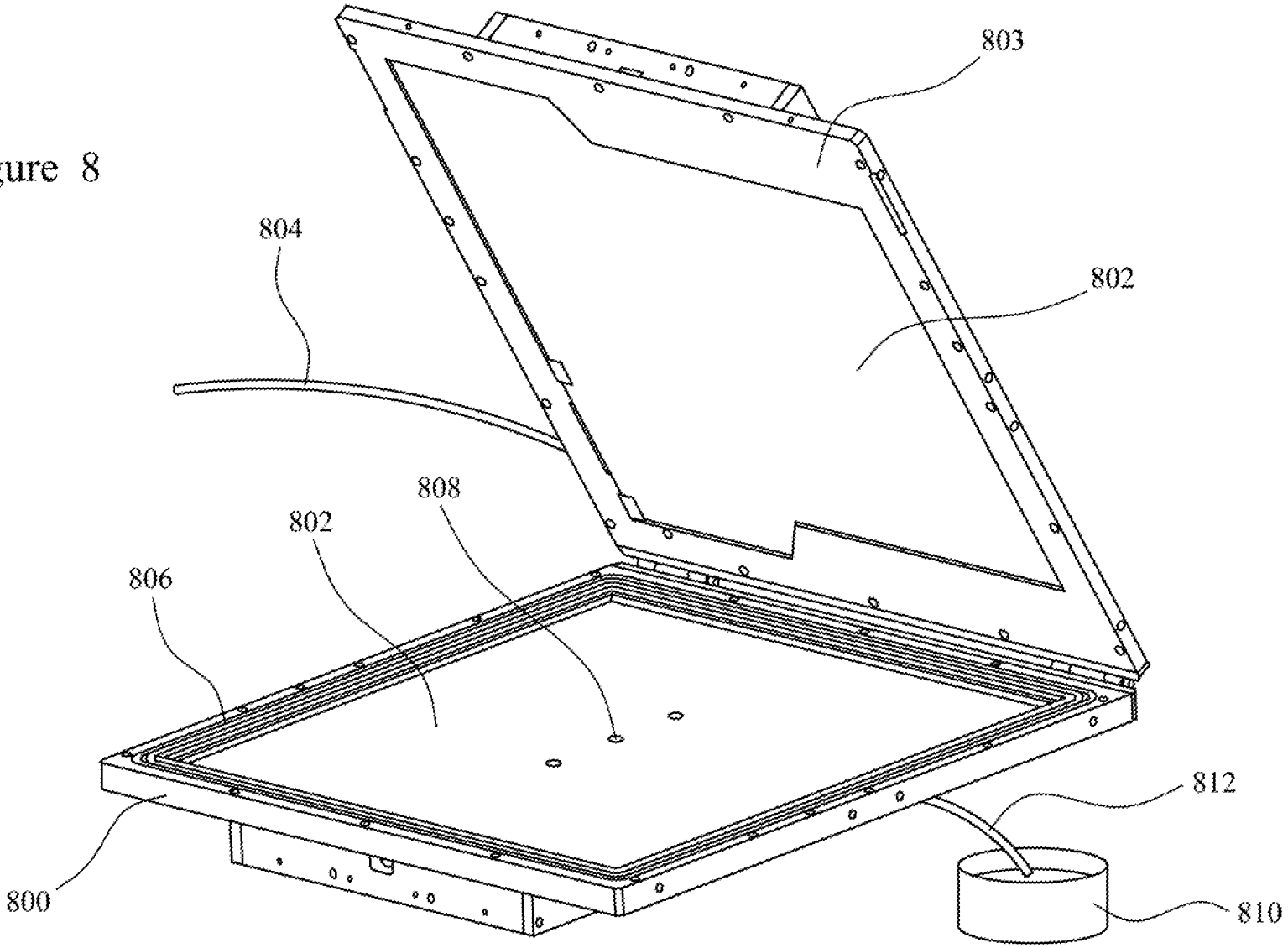
FIG. 8 is as perspective view of a mould used in the method of constructing an x-ray radiation shielding panel in accordance with FIG. 1.

In the manufacture of the panel, a mould is used. FIG. 8 is a perspective view with the mould 800 when open and empty. The mould comprises a main body section 802 defining a cavity and a lid 803. The mould also comprises a binder or resin input port 804 and a vacuum port 808. In FIG. 8 the points where the ports interface the mould are not visible. However, a pipe that protrudes from each of the ports is shown. Around the outside of the cavity is a channel 806. The binder or resin port 804 is connected to the channel 806 such that resin exiting the resin input port 804 flows into the channel 806 and around the periphery of the main body section 802. The resin input port 804 and channel 806 are on the opposite side of the mould to the outlet port 808. The outlet port 808 is connected to a vacuum pump 810. The vacuum pump 810 draws air from the vacuum port and so creates a vacuum in the main body section 802 of the mould when turned on.

Figure 9:
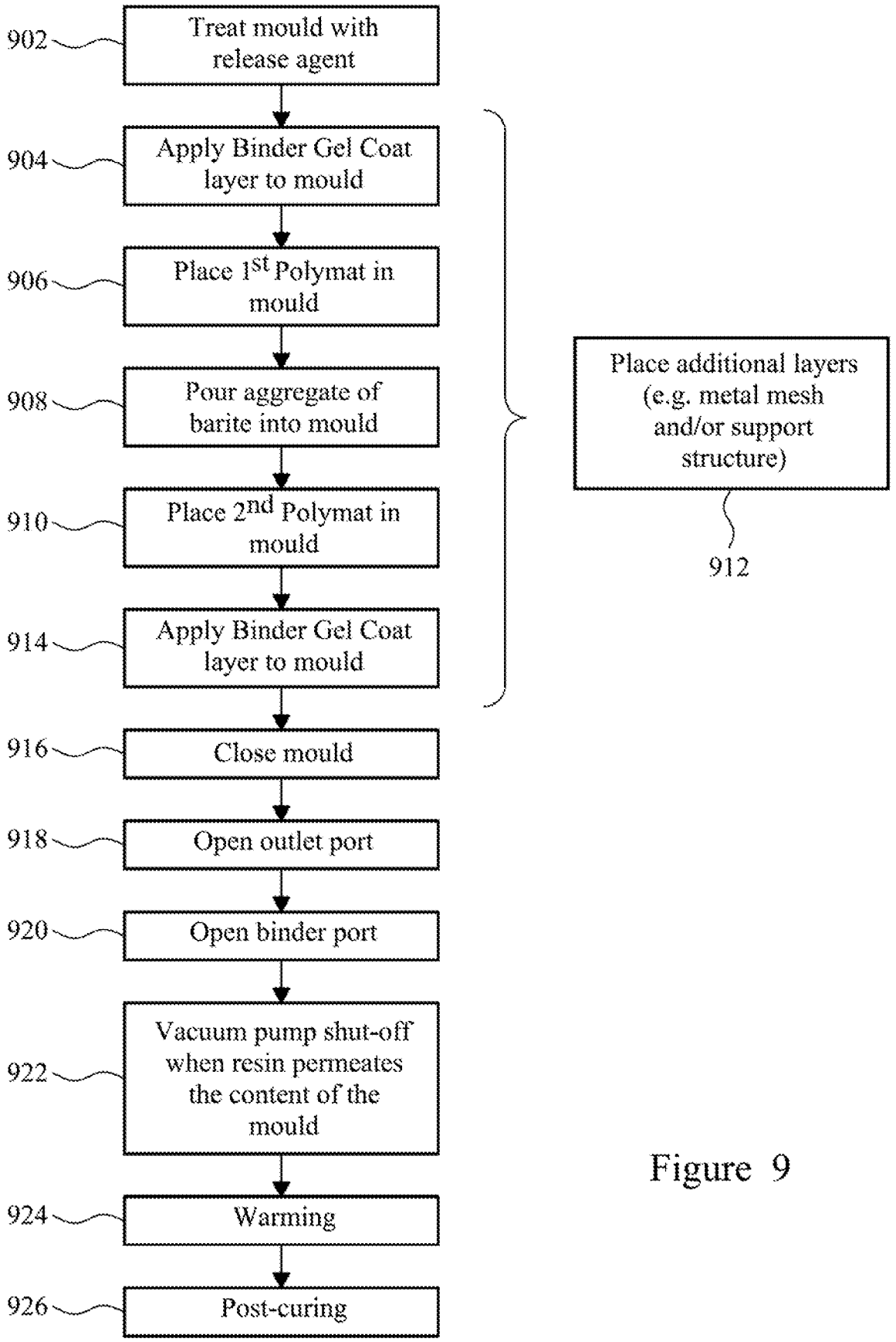
FIG. 9 is a flow chart of a method for constructing a panel of FIG. 1.

FIG. 9 is a flow chart showing a method for producing the radiation shielding panel described above.

Figure 10:
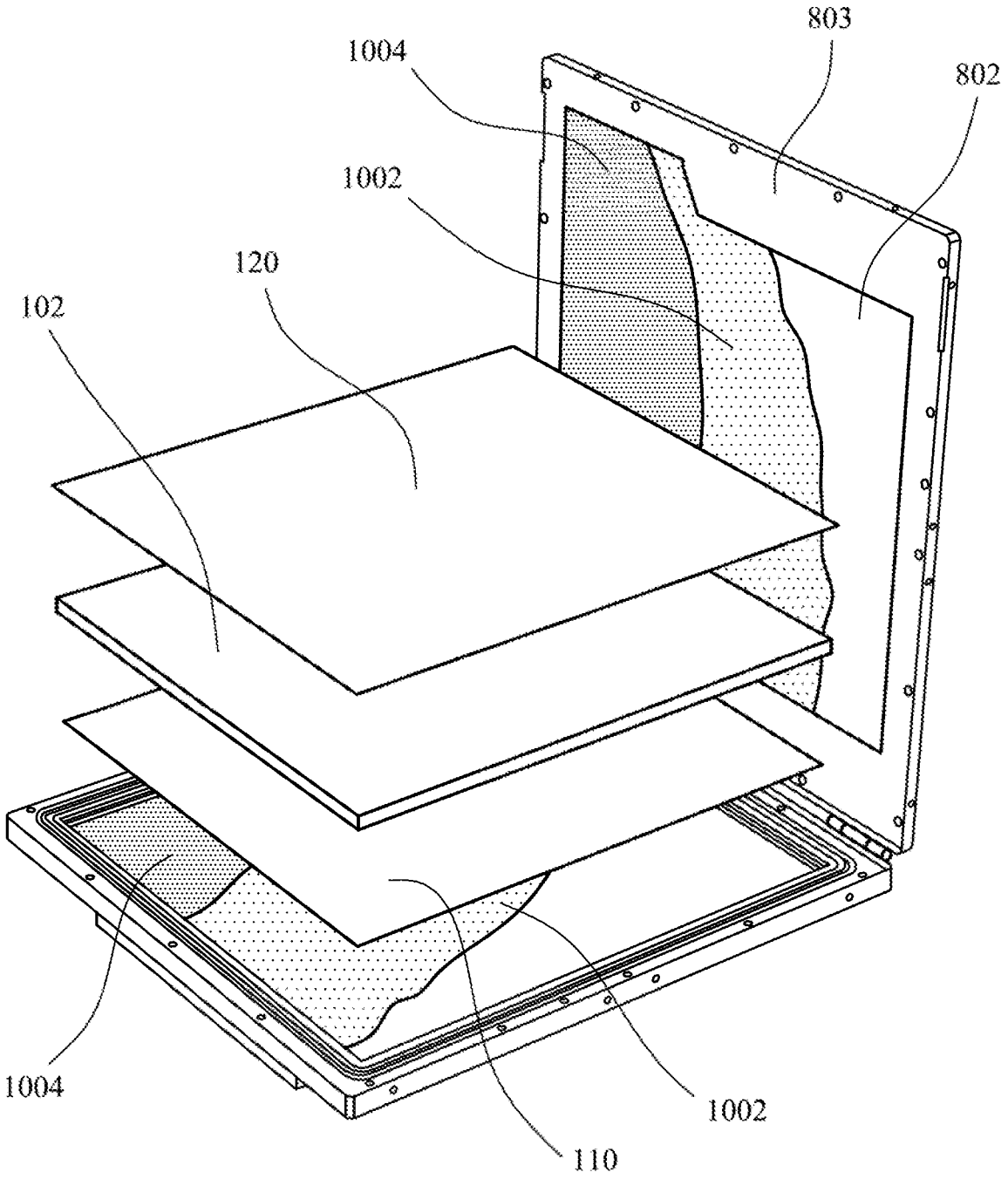
FIG. 10 is a perspective exploded view of the mould of FIG. 8 with all the layers and the method of FIG. 9 placed in the mould.

FIG. 10 is an exploded perspective view of the contents of the mould and the layers that are placed into the mould.

The first step 902 is to treat a mould with a release agent 1002. This aids removal of the radiation shielding panel after it has been moulded. In step 904 a gel coat layer is then applied to the mould.

In step 906 a first Polymat™ Free Flow sheet is placed in the main body section 802 of the mould. The Polymat™ Free Flow sheet 110 comprises three layers. The two outer layers are layers of chopped strand glass fibre The third layer, between the two outer layers, is a resin spreader layer which is a polypropylene needle bonded core. The barite aggregate 104 is then poured into the main body section in step 908, and is spread evenly in the mould. The aggregate of barite 104 is poured to fill the mould to a level higher than the top of the main body section 802 of the mould. In this example it is filled so that the aggregate layer extends to a height of about 10% of the depth of the cavity of the mould above the top of the main body section of the mould.

In step 910 a second Polymat™ Free Flow sheet 120 is placed on top of the barite aggregate, similar to the first Polymat™ Free Flow sheet.

The additional layer of step 912 is not shown in FIG. 10. In this step any additional layers, such as the metal mesh for reflecting electromagnetic radiation or the mechanical load distribution structure 300, are also placed in the main body of the mould. These layers are not, essential for creating a panel capable of absorbing x-rays. They can be placed between any of the other layers already in the mould, or as an external layer, and so step 912 can occur between any of steps 904 to 910. At step 914 a gel coat layer is applied to the top surface of the mould.

In step 916 the mould lid 803 is closed. This compresses the aggregate of barite which, prior to closing, extends above the top of the mould. This compression ensures that the core layer 102 has a high density of barite. This allows the panel to be made as thin as possible which in turn minimises the overall thickness and mass of the radiation shielding panel. Uniform compression using the lid also avoids separation of the larger particles in the aggregate from the smaller ones and helps to ensure a uniform distribution of barite within the mould. Closing the lid 803 of the mould provides a gas tight seal. The process of permeating the contents of the mould with resin can then be initiated.

FIG. 11 shows two cross sectional close up views of portions of the mould after step 916 and so after all the layers have been placed in the mould and it has been closed.

Figure 11A:
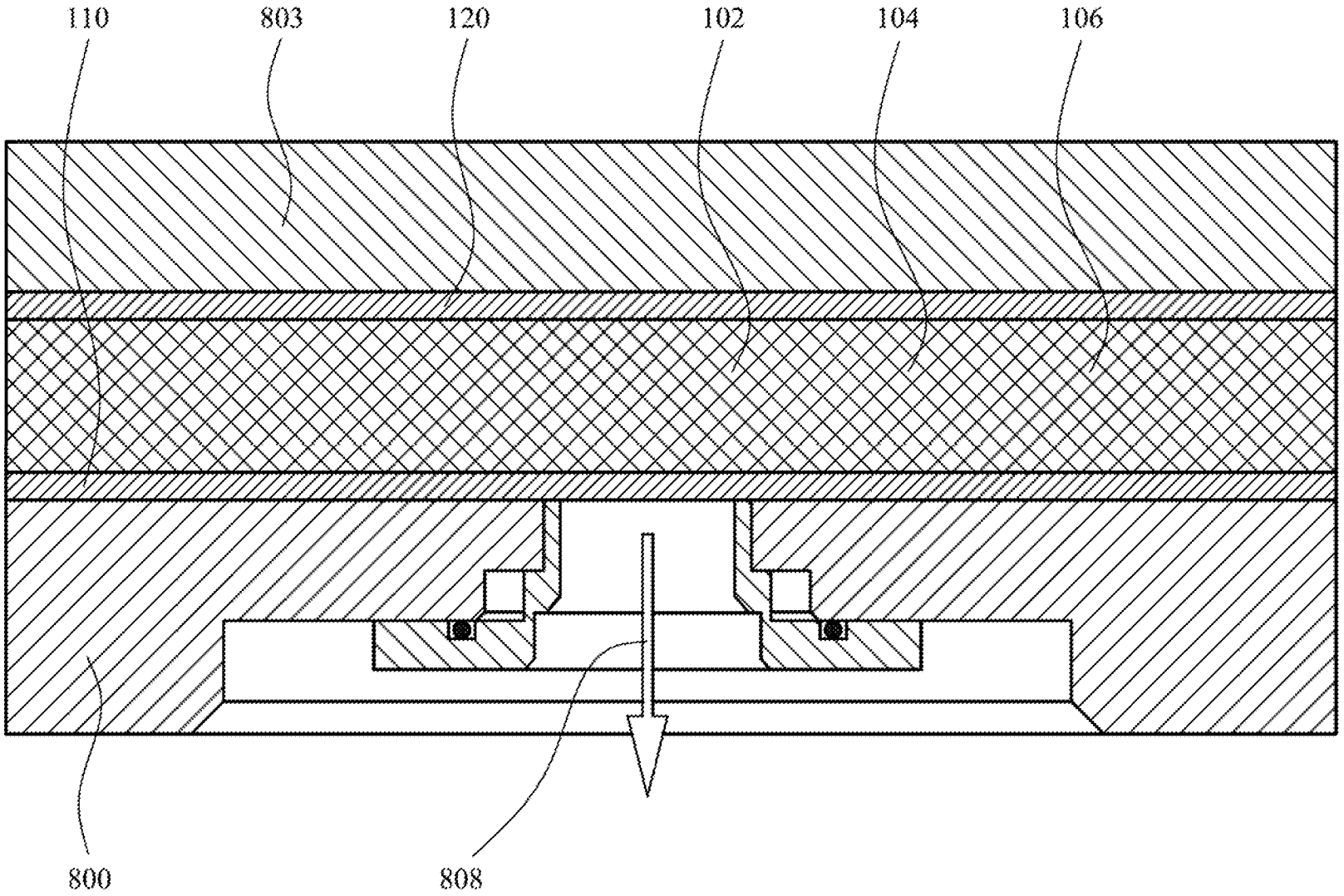
FIG. 11*a* is a cross-sectional view of a vacuum port in the mould of FIG. 8, after the mould has been filled with the components for thrilling the x-ray radiation shielding panel.

FIG. 11*a* is a close-up cross-section view of the vacuum outlet port 810 positioned on the opposite side of the main body of the mould to the resin input port 808. An arrow shows the direction of the resin flow, out of the mould. At step 918 the outlet port 808 is opened and vacuum pump 810 is turned on. The vacuum pump 810 evacuates air from the main body of the mould. The vacuum pump 810 applies a pressure of between 50000 and 100000 Pa below atmospheric pressure.

Figure 11B:
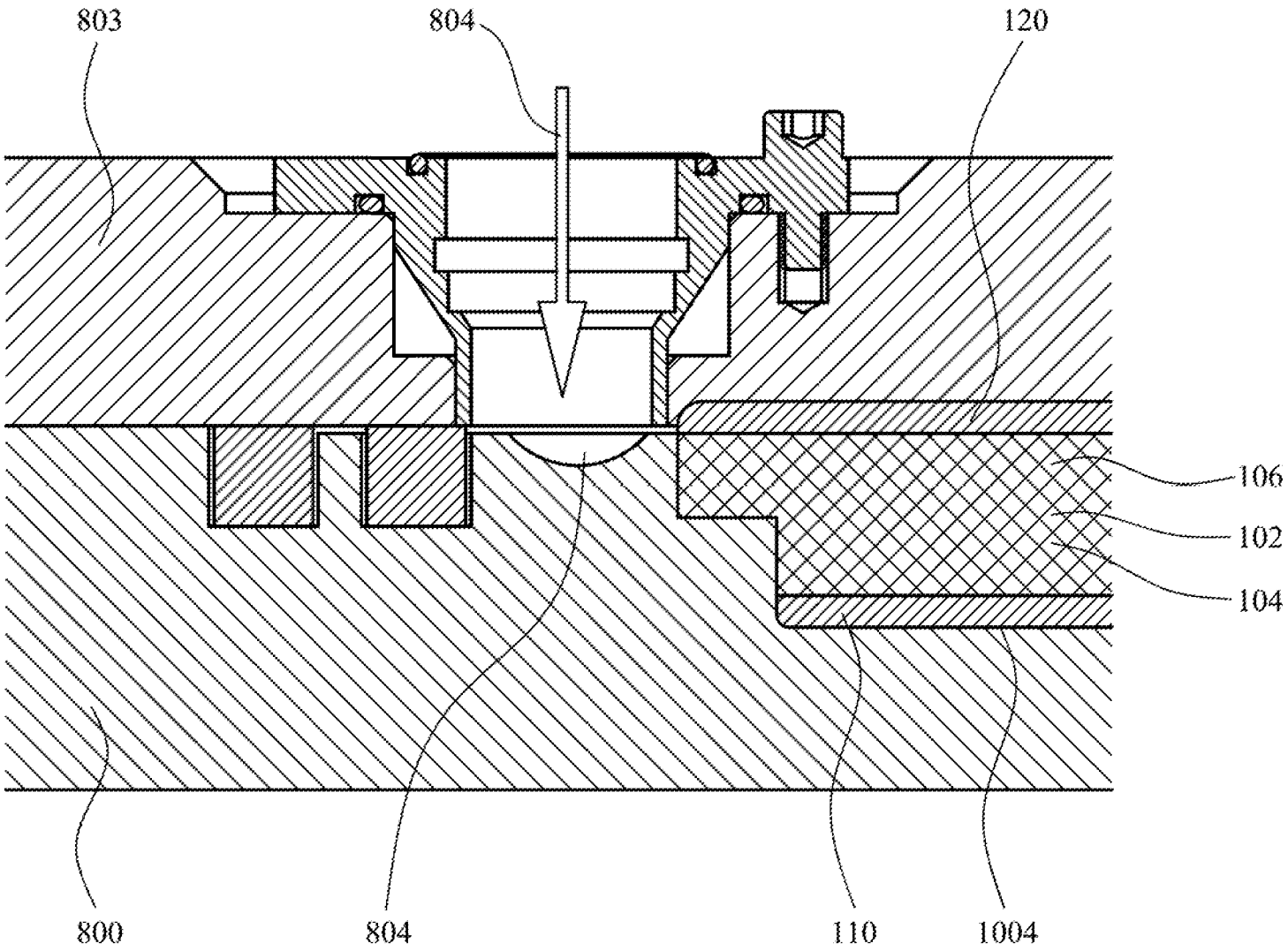
FIG. 11*b* is a cross-sectional view of a resin input port in the mould of FIG. 8, after mould has been filled with the components for forming the x-ray radiation shielding panel.

FIG. 11*b* is a close-up cross-sectional view of the resin input port 804. In step 920 the resin input port 804 is opened, a short time after the outlet port 808 is opened and the vacuum has been switched on. This allows for air in the mould to be evacuated before the resin input port is opened. Resin flows through the input port in the direction shown by the arrow. The resin used is Sicomin™ 8100 resin. At the bottom of the resin input port 804 is the channel 806 into which the resin flows and is spread around the periphery of the main body section of the mould. From the channel 806 the resin passes into the first layer 110. Resin is introduced into the resin input port at a pressure above atmospheric pressure and in the direction shown by the arrow in FIG. 11*b*. The pressure required is dependent on a number of factors, including mould size, and in this example is selected to maintain a flow rate of 0.2 litres per minute at the resin input port. In this example the panel is 1.2 m by 1 m by 24 mm. A pressure of between 50000 and 400000 Pa is desirable. In this example, a pressure of 50000 Pa above atmospheric pressure is used to complete the process. If the permeation of the resin is too fast it can result in disturbance of the aggregate of barite. The combination of the pressure applied to resin entering the input port 804, pushing the resin into the mould, and the vacuum provided by the vacuum pump 810, pulling the resin toward the vacuum port 808, encourages resin to move from the channel 806 and permeate the components in the main body of the mould 802. The vacuum exerts a force on the lid of the mould such that it is pulled in the direction of the vacuum port. This has the effect of compressing the aggregate of barite further than at step 916 after the closure of the lid of the mould. Compressing the barite ensures that the core layer is uniform and dense.

There are two directions of permeation of the resin that are important. The first direction is horizontally across the mould. The second direction is vertically through the mould in the general direction from the resin input port 804 and channel 806 toward the outlet port 808. This second direction of permeation results in resin passing from a higher layer or component in the main body of the mould 802 to a lower layer or component that is closer to the outlet port 808.

After step 920 the process of permeating the contents of the mould with resin is terminated. The process is only terminated after the contents of the mould has been completely permeated with resin. When the resin has completely permeated the panel vertically it will reach the outlet port to which the vacuum pump 810 is connected. The pump is switched off several minutes after the resin comes into contact with outlet port 808. This delay ensures that all air is evacuated from the mould. Resin should be prevented from entering the vacuum pump 810 during this time as it would cause damage to the pump. Entry of resin into the port can be prevented using a fine mesh on the outlet port 808 or by placing additional layers between the outlet port 808 and the constituent parts of the x-ray radiation shielding panel in the mould. Alternatively, resin can be allowed to permeate into the line connecting the mould to the vacuum pump 810, the line is shown as 812 of FIG. 8. A catchpot can be placed between the mould and pump to prevent resin entering the pump. The resin input port 804 is closed before stage 922, several minutes before the vacuum pump has been switched off.

It is necessary to balance the permeation in both the vertical and horizontal directions to ensure that the entire radiation shielding panel is fully permeated with resin before step 922 is reached and permeation is terminated. If, for example, the resin spreads vertically too quickly then there may be regions of the mould that the resin will not have reached. Complete permeation is important in order to create a strong radiation shielding panel. Furthermore, any regions of the core layer, comprising the aggregate of barite, that are not completely permeated with resin may settle and compress over the lifetime of the panel. This mays result in voids opening up in the core layer without the presence of the aggregate of barite. These voids would result in radiation pathways with lower radiation attenuation and so mean that leakage of radiation can occur.

At the beginning of the permeation process resin will leave the channel 806 and pass into the Polymat™ 120. The Polymat™ comprises the resin spreader layer. The resin spreader layer allows for fast horizontal permeation of the resin compared to the rate of vertical permeation. In tis example, horizontal permeation is 30 times faster than vertical permeation. This means that by the time the resin reaches the bottom of the resin spreader layer 124 the entire plane of the resin spreader layer 124 is permeated with resin. From this point on the resin will continue to permeate vertically through the various components in the main body of the mould 902 and horizontal permeation will cease. This avoids disturbance of the aggregate as the resin permeates through the layers subsequent to the Polymat™.

At step 924 the mould is heated to 70° C. warming the Sicomin™ 8100 resin to increase the rate of curing. The resin is hardened in this step. Step 926 is a further hardening step in which the mould is post cured in a bakeout oven. The radiation shielding panel is then fully formed and can be removed from the mould. Fasteners can be attached to the finished panel, as described above, after it has been removed from the mould. A plurality of panels can be manufactured, having different shapes. These can be fitted together to form a cabinet, such as the cabinet of FIG. 5.

The method described with reference to FIG. 9 can be adapted so that a portion of the mould forms a part of the finished radiation shielding panel. If a portion of the mould is not coated with a release agent, the binder may adhere firmly to it and that portion of the mould then forms an external layer of the panel. This may be beneficial in some circumstances. For example, when the panel is to form a door of an x-ray shielding enclosure, having an external layer formed from a sheet of metal provides a convenient structure for attachment of fixings, such as hinges and a door handle.

Figure 12:
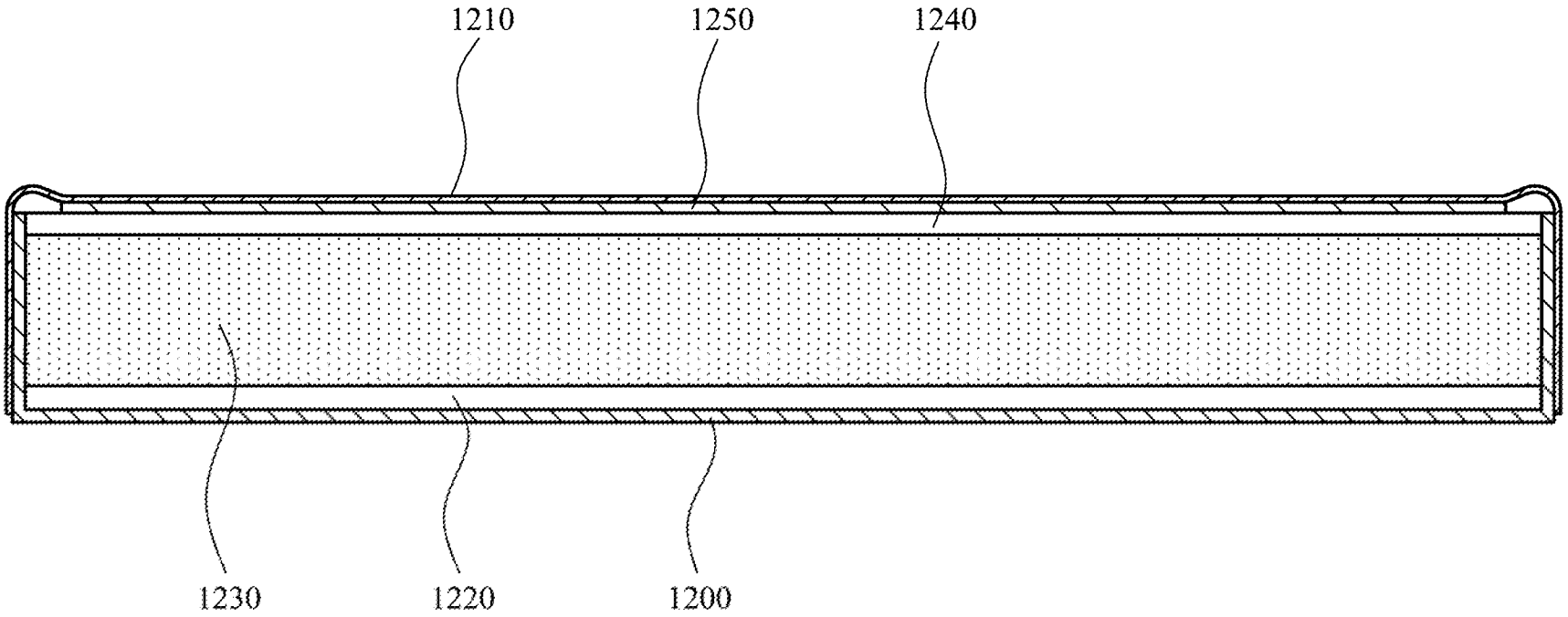
FIG. 12 is a cross sectional view of an embodiment in which a portion of the mould forms an exterior layer of the finished panel, during the moulding process.

FIG. 12 is a cross sectional view of the formation of an x-ray shielding panel in which the lower part of the mould forms part of the finished panel. The upper part of the mould is formed from a flexible sheet formed from polythene. The lower part of the mould 1200 is formed from steel and comprises a base plate and side walls. A first layer of Polymat™ 1220 is first placed in the lower portion of the mould. No release agent or binder gel coat is used on the lower portion of the mould. Then the particulate radiation attenuating material 1230, in this case an aggregate of barite, is poured on top of the first layer of Polymat™. A second layer of Polymat™ 1240 is then placed on the barite.

A thin metal sheet 1250 is laid on top of the second layer of Polymat™ 1240. This metal sheet forms part of the finished panel and provides fire retardancy and EMC shielding. The flexible sheet 1210 that forms the top part of the mould is then placed on top of the metal sheet and adhered to the lower portion of the mould using an adhesive so that the interior of the mould is completely sealed between the lower and upper portions of the mould, except for the provision of one or more resin input ports in the flexible sheet and an output port in the lower portion of the mould (not shown).

The output port is then connected to a vacuum pump and the binder input port(s) connected to a resin supply, as in the process described with reference to FIG. 9. The vacuum pump is switched on first. This evacuates air from the mould and sucks the flexible sheet 1210 down against the contents of the mould, compacting the particulate barite and ensuring all portions of the mould are filled. The resin input port is then opened and the resin introduced through the resin input port at atmospheric pressure. The resin is drawn through the mould by the vacuum pump and the permeation process and curing and post-curing steps are then carried out as described with reference to FIG. 9. The flexible sheet 1210 is then removed from the finished panel and discarded.

A panel that can additionally or alternatively shield types of ionizing radiation different to x-rays can be made by adding materials effective at attenuating that type of ionizing radiation to the particulate material. The shielding panel may be made to shield neutron radiation by adding particulate boron nitride to the particulate material in the panel illustrated in FIG. 1, prior to the infusion of the resin. Alternatively, a layer of particulate boron nitride may be added as a separate layer to the barite. The boron nitride layer may be positioned between the barite and one of the Polymat™ layers and preferably, in use the panel is oriented that the boron nitride is positioned on the side of the barite layer closest to the source of neutron radiation.

A panel of this type, that can shield users from neutron radiation, may be used in medical settings and to surround neutron microscopes, for example. It may be desirable to manufacture neutron radiation shielding panel that are larger than the x-ray shielding panels described above. However, the manufacturing process is essentially the same, and the size of the particles or boron nitride is preferably similar to the size of the panicles of barite. To produce a larger panel it may be desirable to reduce the pressure difference across the mould to increase permeation time. Alternatively, multiple resin input ports and/or multiple output ports may be used.

The invention claimed is:

1. An ionizing radiation shielding panel comprising:

a core layer comprising a radiation attenuating material, a first layer on a first side of the core layer, comprising a permeable reinforcement structure; and a second layer on a second side of the core layer, opposite to the first side, comprising a permeable reinforcement structure, wherein the first layer, second layer and core layer are permeated with a binder.

2. The ionizing radiation shielding panel according to claim 1 wherein the permeable reinforcement structure of the first or second layers is a fabric and comprises glass fibre, or metal filaments, or carbon fibre, or poly-paraphenylene terephthalamide.

3. The ionizing radiation shielding panel according to claim 1 wherein the permeable reinforcement structure of the first layer or second layer, or both the first layer and the second layer comprises a woven fibre cloth, randomly orientated chopped fibre strands, or continuous filaments arranged in a mat, or an array of filaments.

4. The ionizing radiation shielding panel according to claim 1 wherein the first layer or second layer, or both the first layer and the second layer, comprises two or more sheets of the permeable reinforcement structure.

5. The ionizing radiation shielding panel according to claim 1 wherein the first layer or the second layer, or both the first layer and the second layer, comprises a binder spreader layer.

6. The ionizing radiation shielding panel according to claim 5 wherein the binder spreader layer is positioned between the permeable reinforcement structure and the core layer, and wherein the first layer or the second layer, or both the first layer and the second layer, further comprises a second permeable reinforcement structure positioned between the binder spreader layer and the core layer.

7. The ionizing radiation shielding panel according to claim 1 wherein the radiation attenuating material comprises greater than 65% of the binder permeated core layer by volume.

8. The ionizing radiation shielding panel according to claim 1 wherein the radiation attenuating material comprises an element having an atomic mass greater than 47 unified atomic mass units.

9. The ionizing radiation shielding panel according to claim 1 wherein the radiation attenuating material is barite.

10. The ionizing radiation shielding panel according to claim 1, wherein the radiation attenuating material is a particulate, and a diameter of a largest particle of the radiation attenuating material is not more than 10% of a thickness of core layer.

11. The ionizing radiation shielding panel according to claim 1 further comprising a mechanical load distribution structure.

12. The ionizing radiation shielding panel according to claim 11, wherein the mechanical load distribution structure comprises a metal sheet.

13. The ionizing radiation shielding panel according to claim 11, wherein the mechanical load distribution structure is embedded in the binder.

14. The ionizing radiation shielding panel according to claim 11, wherein the mechanical load distribution structure forms an external layer of the ionizing radiation shielding panel and is adhered to the binder.

15. An enclosure comprising a plurality of ionizing radiation shielding panels according to claim 1.

16. The enclosure according to claim 15, wherein the plurality of ionizing radiation shielding panels comprise one or more features that allow a labyrinth to be formed at a junction of at least two of the plurality of ionizing radiation shielding panels.

17. The ionizing radiation shielding panel according to claim 1, wherein at least one of the first layer and the second layer comprises a binder spreader layer, wherein the binder spreader layer is positioned between the permeable reinforcement structure of the first layer and the core layer and the permeable reinforcement structure of the second layer is positioned between the binder spreader layer and the core layer, and wherein the binder comprises a resin and permeates the binder spreader layer.

18. The ionizing radiation shielding panel according to claim 1, wherein at least one of the first layer and the second layer comprise a binder spreader layer positioned between a first mat of fibre strand and a second mat of fibre strand and the binder spreader layer comprises a resin that permeates the binder spreader layer.

19. An ionizing radiation shielding panel comprising:

a core layer comprising a radiation attenuating material, a first layer on a first side of the core layer, comprising a permeable reinforcement structure; and a second layer on a second side of the core layer, opposite to the first side, comprising a permeable reinforcement structure, wherein the first layer, second layer and core layer are permeated with a binder, wherein at least one of the first layer and the second layer comprises a binder spreader layer and a second permeable reinforcement structure, wherein the binder spreader layer is positioned between the permeable reinforcement structure of the first layer and the core layer and the permeable reinforcement structure of the second layer is positioned between the binder spreader layer and the core layer, and wherein the binder comprises a resin and permeates the binder spreader layer.

20. The ionizing radiation shielding panel according to claim 19 wherein the permeable reinforcement structure of the first or second layers is a fabric and comprises glass fibre, or metal filaments, or carbon fibre, or poly-paraphenylene terephthalamide.

21. The ionizing radiation shielding panel according to claim 19 wherein the permeable reinforcement structure of the first layer or second layer, or both the first layer and the second layer comprises a woven fibre cloth, randomly orientated chopped fibre strands, or continuous filaments arranged in a mat, or an array of filaments.

22. The ionizing radiation shielding panel according to claim 19 wherein the first layer or second layer, or both the first layer and the second layer, comprises two or more sheets of the permeable reinforcement structure.

23. The ionizing radiation shielding panel according to claim 19 wherein the first layer or the second layer, or both the first layer and the second layer, comprises a binder spreader layer.

24. The ionizing radiation shielding panel according to claim 23 wherein the binder spreader layer is positioned between the permeable reinforcement structure and the core layer, and wherein the first layer or the second layer, or both the first layer and the second layer, further comprises a second permeable reinforcement structure positioned between the binder spreader layer and the core layer.

25. An ionizing radiation shielding panel comprising:

a core layer comprising a radiation attenuating material, a first layer on a first side of the core layer, comprising a permeable reinforcement structure; and a second layer on a second side of the core layer, opposite to the first side, comprising a permeable reinforcement structure, wherein the first layer, second layer and core layer are permeated with a binder, and wherein at least one of the first layer and the second layer comprise a binder spreader layer positioned between a first mat of fibre strand and a second mat of fibre strand and the binder spreader layer comprises a resin that permeates the binder spreader layer.

26. The ionizing radiation shielding panel according to claim 25 wherein the permeable reinforcement structure of the first or second layers is a fabric and comprises glass fibre, or metal filaments, or carbon fibre, or poly-paraphenylene terephthalamide.

27. The ionizing radiation shielding panel according to claim 25 wherein the permeable reinforcement structure of the first layer or second layer, or both the first layer and the second layer comprises a woven fibre cloth, randomly orientated chopped fibre strands, or continuous filaments arranged in a mat, or an array of filaments.

28. The ionizing radiation shielding panel according to claim 25 wherein the first layer or second layer, or both the first layer and the second layer, comprises two or more sheets of the permeable reinforcement structure.

29. The ionizing radiation shielding panel according to claim 25 wherein the first layer or the second layer, or both the first layer and the second layer, comprises a binder spreader layer.

30. The ionizing radiation shielding panel according to claim 29 wherein the binder spreader layer is positioned between the permeable reinforcement structure and the core layer, and wherein the first layer or the second layer, or both the first layer and the second layer, further comprises a second permeable reinforcement structure positioned between the binder spreader layer and the core layer.

* * * * *